United States Patent [19]

Martin

[11] Patent Number: 4,585,230

[45] Date of Patent: Apr. 29, 1986

[54] FINGER HOLE INSERT FOR BOWLING BALLS

[76] Inventor: Richard J. Martin, 1140 Parkington Ave., Sunnyvale, Calif. 94087

[21] Appl. No.: 615,833

[22] Filed: May 31, 1984

[51] Int. Cl.[4] ..... A63B 37/00

[52] U.S. Cl. ..... 273/63 A; 273/DIG. 29

[58] Field of Search ..... 273/63 A, 63 R, 63 B, 273/63 F

[56] References Cited

U.S. PATENT DOCUMENTS

| | | | |
|---|---|---|---|
| 2,661,951 | 12/1953 | Uhas | 273/63 A |
| 3,804,412 | 4/1974 | Chetirko | 273/63 A |
| 4,358,112 | 11/1982 | Straborny | 273/63 A |
| 4,432,546 | 2/1984 | Allen | 273/63 A |

*Primary Examiner*—George J. Marlo

*Attorney, Agent, or Firm*—Schapp and Hatch

[57] ABSTRACT

A finger hole insert characterized by a tubular body provided with a wedge shaped portion longitudinally extending along an inner wall surface. The wedge shaped portion includes a pair of planar surface portions angled at 80°-120° relative each other. The wedge shaped portion permits better control of the ball by increasing the frictional engagement between the finger tip and the ball at certain times during the bowler's swing, but does not interfere with the release of the bowling ball.

3 Claims, 11 Drawing Figures

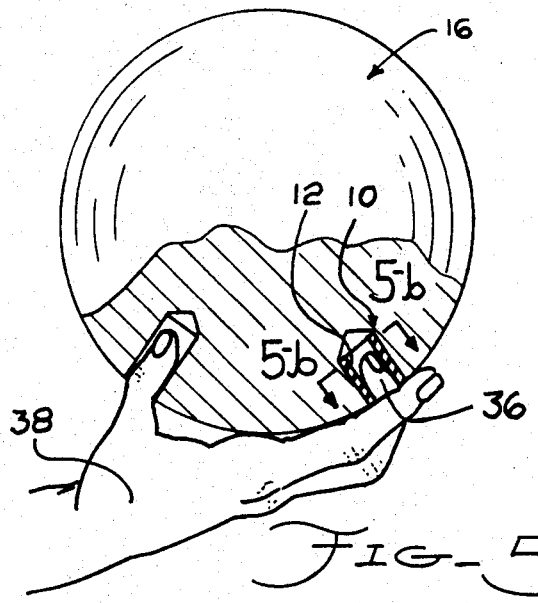
FIG. 5-a
FIG. 5-b
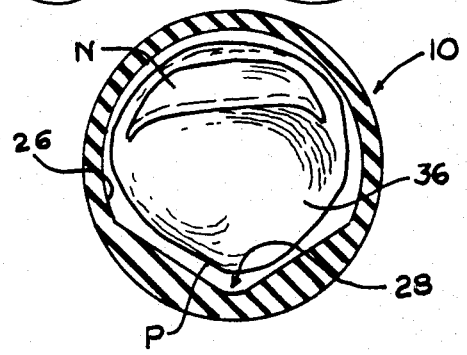
FIG. 6-b
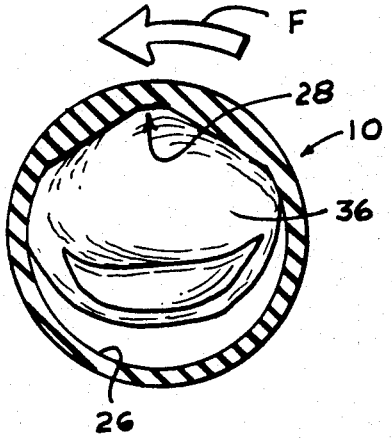
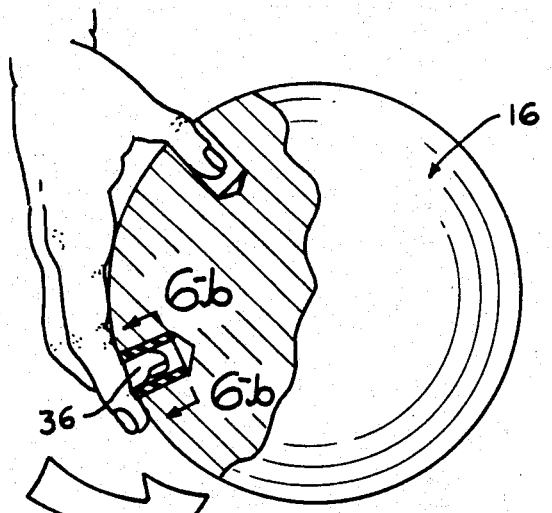
FIG. 6-a
FIG. 7-a
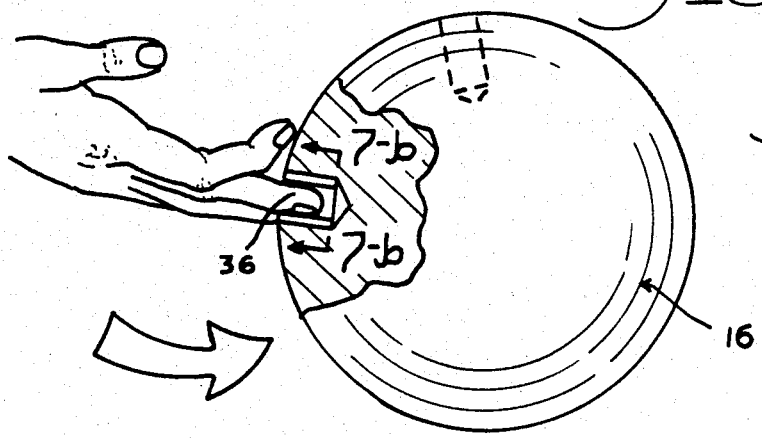
FIG. 7-b
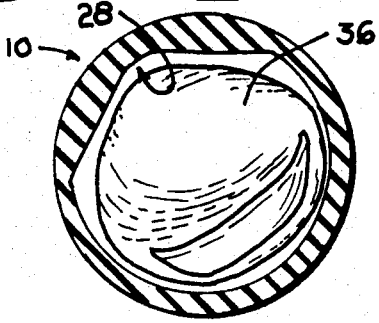

FINGER HOLE INSERT FOR BOWLING BALLS

BACKGROUND OF THE INVENTION

1. Field of the Invention

This invention relates generally to athletic equipment and more particularly to inserts for the finger holes of bowling balls.

2. Description of the Prior Art

A bowling ball is provided with a pair of finger holes and a thumb hole. The finger holes of the bowling ball are adapted to receive the two center fingers of a bowler's hand.

Depending on the spacing between the finger holes and the thumb hole of the bowling ball, the bowler's middle fingers are inserted into the finger holes to the depth of either the first finger joint or the second finger joint. Most skilled bowlers use bowling balls which only allow the first finger joint of the bowler's hand to be inserted into the finger holes. This is known as the "finger tip grip" configuration for a bowling ball, and affords maximum power and control over the ball.

A problem with finger tip grips for bowling balls is that the frictional engagement area between the finger tip and the finger hole is small, requiring a tighter compressive grip by the bowler to properly hold and release the ball. To offset this problem, a number of finger hole inserts for bowling balls have been invented.

In U.S. Pat. No. 4,358,112 of Straborny, a finger hole insert for bowling balls is disclosed which includes a tubular member having a thickened wall portion provided with a slot. The slot facilitates the entry of air into the finger hole and reduces the problem of vacuum caused by the rapid removal of the fingers from the insert during the release of the ball.

In U.S. Pat. No. 4,432,546 of Allen, Jr. an insert is described having a high friction, corrugated surface which enhances the grip of the finger tip. The finger opening of the insert can be adjusted for various finger sizes.

Bach in U.S. Pat. No. 3,784,198 teaches a finger hole liner provided with a key-like ridge adapted to lock to a keyway or circumferential groove formed within the finger hole of a bowling ball. The finger hole of Bach's liner is substantially elliptical.

Similar finger hole inserts can be found in U.S. Pat. No. 4,381,863 of Norman, U.S. Pat. No. 580,207 of Boemermann et al., U.S. Pat. No. 2,469,268 of Jerome, U.S. Pat. No. 2,646,985 of Nagy et al., U.S. Pat. No. 2,482,190 of Kramer, and U.S. Pat. No. 4,289,312 and U.S. Pat. No. 4,416,452 both of Heimbigner.

All of the above cited patents teach finger hole inserts having a generally cylindrical outer surface and an inner surface adapted to engage a bowler's finger tip. The prior art inserts generally include an internal surface configuration or lip configuration which engages the bowler's finger tip to provide enhanced frictional contact between the finger tip and the insert. This enhanced frictional engagement is active throughout the entire swing and release of the bowling ball.

A problem that the prior art does not address is the fact that increased frictional engagement between the finger tip and the bowling ball insert is not desirable at all points of the swing and release of the ball. For example, the frictional engagement between the finger tip and the insert should be minimized at the time of release of a ball so that the bowling ball can be easily and smoothly released.

SUMMARY OF THE INVENTION

A major object of this invention is to provide a finger hole insert for bowling balls which increases the frictional engagement between the finger tip and the bowling ball during certain portions of the bowler's swing, but which does not increase the frictional engagement during other portions of the swing and during the release of the ball.

Briefly, the invention comprises a hollow body having a cylindrical outer surface, an open bottom end, and an open upper end, the hollow body having a wedge shaped portion extending along its inner surface from the top end towards the bottom end. With the exception of the wedge shaped portion, the remainder of the inner surface of the hollow body is substantially cylindrical. The open top and bottom end provide for easy ball inspection.

The wedge shaped portion preferably includes a pair of non-parallel, substantially planar surface portions. The angle between the planar surface portions may be acute, but is preferably obtuse. The planar surface portions may be connected by a flat or curved connecting portion, or they may intersect in a sharp, V-shaped cross section.

An advantage of this invention is that the wedge shaped configuration of the inner surface of the insert provides a strong frictional engagement between the finger tip and the insert whenever the weight of the ball rests upon the finger tip. At the point of release of the bowling ball, the weight is off the bowler's finger tips and thus the finger is free to slide from the insert with very little frictional engagement.

These and other objects and advantages of the present invention will no doubt become apparent upon a reading of the following descriptions and a study of the several figures of the drawing.

BRIEF DESCRIPTION OF THE DRAWING

FIG. 5*a* is a partially broken elevational view of a bowler's hand before the start of his approach.

FIG. 5*b* is a cross-sectional view taken along line 5*b*—5*b* of FIG. 5*a*.

FIG. 6*a* is a partially broken elevational view of a bowler's hand at the beginning of his release of the bowling ball.

FIG. 6*b* is a cross-sectional view taken along line 6*b*—6*b* of FIG. 6*a*.

FIG. 7*a* is a partially broken elevational view of a bowler's hand at the end of his release of the bowling ball.

FIG. 7*b* is a cross-sectional view taken along line 7*b*–7*b* of FIG. 7*a*.

DETAILED DESCRIPTION OF THE PREFERRED EMBODIMENT(S)

Figure 1:
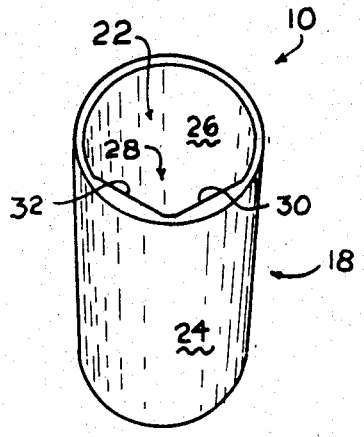
FIG. 1 is a perspective view of a bowling ball finger hole insert in accordance with the present invention.
Figure 2:
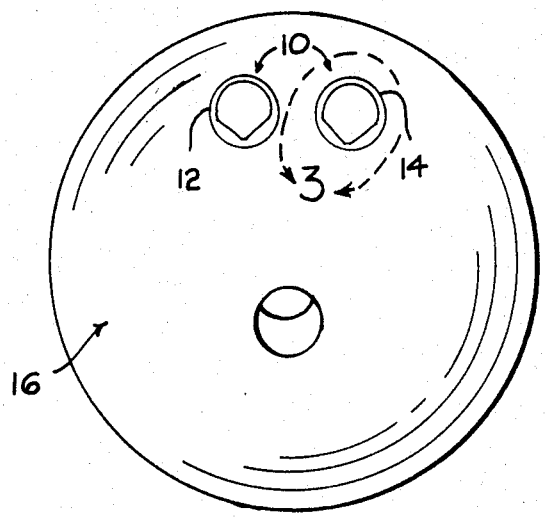
FIG. 2 is a perspective view of a bowling ball with two inserts placed in the finger holes.

Referring to FIGS. 1, 2, 3, and 4, an insert 10 for the finger holes 12 and 14 of a bowling ball 16 includes a hollow, cylindrical portion 18, an open bottom end 20, and an open top end 22. Cylindrical portion 18 includes a substantially cylindrical outer surface 24, and a substantially cylindrical inner surface 26.

A portion 28 of inner surface 26 is not, however, cylindrical and is, in fact, wedge shaped. Wedge shaped portion 28 includes a first planar portion 30, and a second planar portion 32. The angle A between first planar portion 30 and second planar portion 32 is preferably in the range of 80°–120°. Empirical data indicates that the optimal angle A may be approximately 110°.

Figure 4:
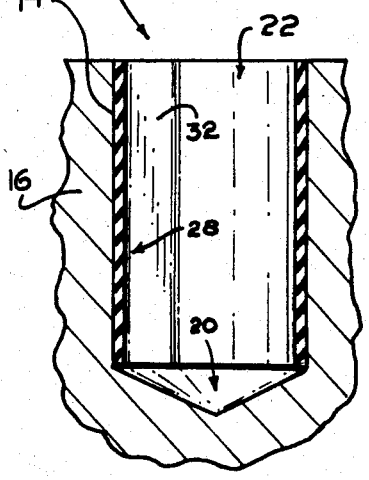
FIG. 4 is a cross-sectional view taken along line 4—4 of FIG. 3.

As seen in FIG. 4, the planar portion 32 (and by analogy planar portion 30) extends substantially the entire distance between open top end 22 and open bottom end 20. It is not strictly necessary for the planar portions 30/32 to extend completely between the top end 22 and bottom end 20, but only a sufficient distance so as to engage the bowler's finger tip up to the first joint.

Planar portions 30/32 converge on a connecting portion 34 to give wedge portion 28 a V-shaped cross section having a flattened apex. Connecting portion 34 can either be a planar or a curved surface.

Figure 3:
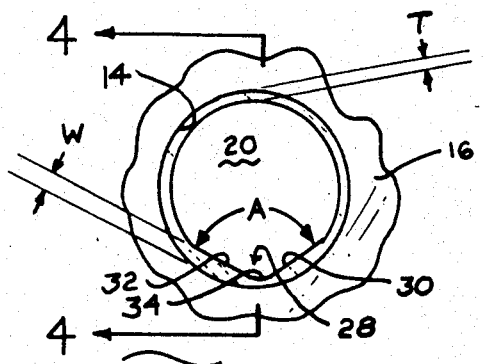
FIG. 3 is an enlarged, plan view of the insert encircled by line 3 of FIG. 2.

Referring to FIG. 3, the thickness T of the wall of cylindrical portion 18 is preferably 0.062 inches. The thickness W of first planar portion 32 (and by analogy second planar portion 30) is preferably 0.092 inches. The wall thickness T of cylindrical portion 18 is made as thin as possible to minimize the gap between the cavities of the adjacent pair of inserts 10 which is known in bowling circles as the bowling ball's "bridge".

The insert 10 is preferably made from pure silicon rubber which provides a good gripping surface that releases easily. However, other synthetic and natural materials can also be used.

Referring now to FIGS. 5*a* and 5*b*, a finger tip 36 of a bowler's hand 38 is engaged with an insert 10 of a finger hole 12. This grip is typical for a bowler standing at his starting position prior to his approach to the foul line of the bowling alley. As seen in 5*b*, the pad portion P of finger tip 36 is facing the wedge portion 28 of insert 10, and the nail portion N of finger tip 36 is facing away from wedge portion 28. In this position, there is substantially no pressure upon finger tip pad P and thus there is little friction between the finger tip and the inner surface 26 of insert 10.

As the bowler approaches the foul line of the bowling alley, he swings the bowling ball 16 back and then forward in a pendulum like arc. As seen in FIG. 6*a*, during the pendulum swing much of the weight of ball 16 rests upon the finger tips 36. As seen in FIG. 6*b*, this forces finger tip 36 firmly into wedge portion 28 of insert 10 providing a strong frictional engagement between finger tip 36 and the insert 10, allowing the bowler to exert a strong rotational force on the bowling ball as indicated at F. This rotational force causes bowling ball 10 to spin or "hook", which is strongly desired by most bowlers. Finger tip 36 is usually firmly engaged with the wedge until just before the release of the ball to afford the maximum spin.

Without the wedge shaped portion 28 of inner surface 26, the amount of rotational force F would be limited by the amount of frictional contact between the finger tip 36 and the inner surface 26. For example, if the inner surface 26 were a smooth cylindrical surface, there would be a tendency for the finger tip to rotate within the cavity of insert 10 rather than to transmit rotational force to the bowling ball 16.

Referring now to FIG. 7*a*, just at the moment of release of ball 16 there is very little weight or pressure on the finger tip 36. As seen in FIG. 7*b*, the finger tip 36 is substantially disengaged with wedge portion 28 so that there is very little frictional engagement between the finger tip 36 and insert 10. This allows the ball 16 to be released easily.

Figure 8:
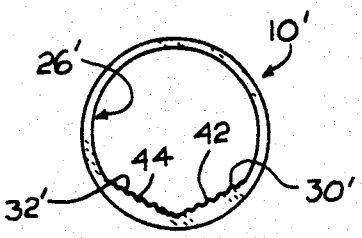
FIG. 8 is a view similar to FIG. 3 showing a slightly alternate embodiment of the present invention.

Referring now to the alternate embodiment of FIG. 8, the inner surface 26' of a bowling ball insert 10' may be provided with a wedge portion 28' having planar portions 30' and 32' which converge in a sharp, V shaped apex 40. Planar portions 30' and 32' may be provided with a roughened, frictional surfaces 42 and 44, respectively, to increase the frictional engagement between insert 10' and the bowler's finger tip.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A bowling ball finger hole insert of generally tubular configuration and formed from resilient material, characterized by:

an outer surface substantially coincident with an outer right circular cylinder; and an inner surface comprising a major portion substantially coincident with an inner right circular cylinder which is substantially coaxial with said outer right circular cylinder, and two adjacent minor surface portions which are disposed at an angle to each other and are not coincident with said inner right circular cylinder and have an inner surface configuration such that the radial distance between each of said minor surface portions and said outer right circular cylinder is substantially greater than the radial distance between said inner and outer right circular cylinders.

2. A bowling ball finger hole insert as claimed in claim 1 in which each of said minor portions is substantially planar.

3. A bowling ball finger hole insert as claimed in claim 1 in which said minor portions are textured to promote engagement with a bowler's finger.

* * * * *